US012157974B2

(12) United States Patent
Nordstrom

(10) Patent No.: US 12,157,974 B2
(45) Date of Patent: Dec. 3, 2024

(54) PAPER PRODUCTION

(71) Applicant: Billerudkorsnas AB, Solna (SE)

(72) Inventor: Fredrik Nordstrom, Karlstad (SE)

(73) Assignee: BILLERUDKORSNAS AB, Solna (SE)

( * ) Notice: Subject to any disclaimer, the term of this patent is extended or adjusted under 35 U.S.C. 154(b) by 233 days.

(21) Appl. No.: 17/767,555

(22) PCT Filed: Oct. 9, 2020

(86) PCT No.: PCT/EP2020/078471
§ 371 (c)(1),
(2) Date: Apr. 8, 2022

(87) PCT Pub. No.: WO2021/069696
PCT Pub. Date: Apr. 15, 2021

(65) Prior Publication Data

US 2023/0056642 A1 Feb. 23, 2023

(30) Foreign Application Priority Data

Oct. 10, 2019 (EP) ..... 19202428

(51) Int. Cl.

| | |
|---|---|
| ***D21F 11/02*** | (2006.01) |
| ***D21F 1/00*** | (2006.01) |
| ***D21H 11/04*** | (2006.01) |
| ***D21H 11/06*** | (2006.01) |

(52) U.S. Cl.
CPC ..... *D21F 11/02* (2013.01); *D21F 1/0018* (2013.01); *D21H 11/04* (2013.01); *D21H 11/06* (2013.01)

(58) Field of Classification Search
CPC ..... D21F 11/02; D21F 1/0018; D21H 11/04; D21H 11/06; D21H 25/005; D21H 27/10; D21D 1/00; D21C 9/007
See application file for complete search history.

(56) References Cited

U.S. PATENT DOCUMENTS

| | | | | |
|---|---|---|---|---|
| 5,211,815 | A * | 5/1993 | Ramasubramanian | D21F 11/006 162/903 |
| 2003/0056915 | A1* | 3/2003 | Hietanen | D21H 11/02 162/135 |
| 2010/0300633 | A1* | 12/2010 | Goto | D21H 21/10 162/164.6 |
| 2016/0017543 | A1 | 1/2016 | Bertrand | |

FOREIGN PATENT DOCUMENTS

| | | | |
|---|---|---|---|
| CN | 101372822 | A | 2/2009 |
| CN | 102493284 | A | 6/2012 |
| CN | 102888778 | A | 1/2013 |
| EP | 2157237 | A1 | 2/2010 |
| JP | 2015209614 | A | 11/2015 |

* cited by examiner

*Primary Examiner* — Jacob T Minskey
*Assistant Examiner* — Matthew M Eslami
(74) *Attorney, Agent, or Firm* — Stites & Harbison PLLC; Richard S. Myers, Jr.

(57) ABSTRACT

There is provided a method of producing a paper, comprising the steps of: a) providing a pulp having a Schopper-Riegler (SR) number measured according to ISO 5267-1: 1999 of 25-50, which pulp comprises at least 70% by weight sulphate or sulphite pulp; b) diluting the pulp to a consistency of 0.1%-0.9%; and c) forming a web from the diluted pulp from step b) in a forming section at a machine speed of at least 1100 m/min, such as 1100-1800 m/min.

15 Claims, No Drawings

PAPER PRODUCTION

CROSS REFERENCE TO RELATED APPLICATIONS

This application is a § 371 National Stage Application of PCT/EP2020/078471 filed Oct. 9, 2020, which claims priority to EP 19202428.9 filed Oct. 10, 2019.

TECHNICAL FIELD

The present disclosure relates to the field of papermaking, in particular the production of a high-density paper.

BACKGROUND

Paper and board made from cellulose wood fibres are stiff materials considering their relatively low weight. The stiffness in combination with the fact that they can be produced using environmentally friendly processes make them suitable for use in packages where rigidity and/or grip stiffness are desired properties.

Paper and board, however, normally have poor barrier properties, which means that such materials typically cannot be used for packaging content sensitive to oxygen, water vapour and/or liquids unless a barrier is provided by other means. A typical example of a moisture barrier is polyethylene and an aluminium foil is frequently use for protection against gases such as oxygen and water vapor.

Cellulose fibres have inherent gas barrier properties. Paper on the other hand normally has poor oxygen barrier properties because there are pores in the paper.

Vegetable parchment is a paper that from the beginning has a relatively open/porous structure, but after web forming passes a bath of sulphuric acid. After the bath, the web is washed and neutralized. The strong acid gelatinizes the cellulosic fibres and a large part of the fibre surface is bounded. The paper becomes transparent (also brittle), which proves that the pores have been more or less eliminated and that the paper has achieved oxygen barrier properties. The manufacturing process for such a paper is complicated and therefore too costly for many applications.

By processing a pretreated pulp in a homogenizer in one or more steps, cellulose fibres will be separated into microfibrils. These entangled fibrils are called microfibrillated cellulose (MFC). Sheets or films of the MFC form a barrier against oxygen. MFC films may therefore appear to be an obvious solution for a packaging concept requiring barrier properties. However, like vegetable parchment, the production costs are too high, mainly because the dewatering resistance of the MFC, which requires a long forming section operated at low speed. Further, there are practical limitations to the width of a machine for producing an MFC film and energy costs will be substantial.

SUMMARY

In order to obtain a paper that forms an oxygen barrier, the number and the size of the pores must be significantly reduced. By extensive refining of the pulp, the degree of fibre bonding will increase and thus reduce the porosity. Greaseproof paper, that is produced according to this method, has sufficiently low porosity to provide a grease barrier. Greaseproof paper may be used as a substrate/carrier for an additional barrier, in particular if it has been smoothened by a pre-coating with a primer. The process of producing greaseproof paper is however inefficient and thus costly. There are several reasons for the inefficiency, e.g. high energy consumption in the refining, high dewatering resistance of the pulp that demands long time for stock dewatering and a low press solids content after the press section that results in high steam demand.

An objective of the present disclosure is to provide efficient process solutions for the formation of a paper substrate to be used in a barrier material.

The objective is met by the following itemized embodiments.

1. A method of producing a paper, comprising the steps of:
   a) providing a pulp having a Schopper-Riegler (SR) number measured according to ISO 5267-1:1999 of 25-50, which pulp comprises at least 70% by weight sulphate or sulphite pulp;
   b) diluting the pulp to a consistency of 0.1%-0.9%; and
   c) forming a web from the diluted pulp from step b) in a forming section at a machine speed of at least 1100 m/min, such as 1100-1800 m/min.
2. The method of item 1, wherein the pulp comprises less than 5% by dry weight pigment, such as less than 3% by weight pigment, such as less than 1% by dry weight pigment, such as substantially no pigment.
3. The method of item 1 or 2, wherein the pulp is diluted to a consistency of 0.1%-0.5%, such as 0.2%-0.4%, in step b).
4. The method of any one of the preceding items, wherein the machine speed in step c) is at least 1250 m/min, such as 1250-1800 m/min.
5. The method of any one of the preceding items, wherein the grammage according to ISO 536:2012 of the paper is 42-60 g/m$^2$, such as 50-60 g/m$^2$.
6. The method of any one of the preceding items, wherein the Gurley value according to ISO 5636-5:2013 of the paper is above 220 s.
7. The method of any one of the preceding items, wherein the pulp comprises hardwood pulp and softwood pulp.
8. The method of item 7, wherein the pulp comprises at least 30% by dry weight hardwood pulp and at least 30% by dry weight softwood pulp.
9. The method of any one of the preceding items, wherein the pulp comprises at least 60% by dry weight softwood pulp and the pulp is diluted to a consistency of 0.1%-0.3% in step b).
10. The method of any one of the preceding items, wherein the pulp comprises at least 70% by dry weight softwood pulp and has a Schopper-Riegler (SR) number measured according to ISO 5267-1:1999 of 25-35.
11. The method of any one of items 1-9, wherein the pulp comprises at least 70% by dry weight hardwood pulp and has a Schopper-Riegler (SR) number measured according to ISO 5267-1:1999 of 35-50.
12. The method of any one of the preceding items, wherein step a) comprises subjecting a starting pulp to low consistency (LC) refining to obtain the pulp.
13. The method of item 12, wherein said LC refining comprises at least two consecutive steps, such as at least three consecutive steps.
14. The method of any one of the preceding items, wherein the dry matter content of the web leaving the forming section of step c) has a dry matter content of 17%-23%, such as 18%-22%.
15. The method of any one of the preceding items, further comprising the steps of pressing the web from step c) and drying the pressed web.
16. The method of item 15, further comprising the step of calendering the dried web.

17. A method of producing a paper, comprising the steps of:

α) obtaining a web from a forming section;

β) subjecting the web to pressing in a press section comprising a first, a second and a third nip, wherein the first nip is double-felted and the second and the third nip are single-felted and wherein the third nip is a shoe nip being operated at a line load of at least 1300 kN/m, such as at least 1500 kN/m; and γ) obtaining from the press section a pressed web having dry matter content of 42%-48%, such as 43%-47%.

18. The method of item 17, wherein the web is formed from a pulp comprising at least 50% sulphate or sulphite pulp, such as at least 70% sulphate or sulphite pulp.

19. The method of item 17 or 18, wherein the web is formed from a pulp comprising less than 10% by dry weight inorganic filler, such as less than 5% by weight inorganic filler, such as less than 1% by dry weight inorganic filler, such as substantially no inorganic filler.

20. The method of any one of items 17-19, wherein the web is formed from a pulp having a Schopper-Riegler (SR) number measured according to ISO 5267-1:1999 of 25-50, such as 30-45.

21. The method of any one of items 17-20, wherein the grammage according to ISO 536:2012 of the paper is 35-100 g/m$^2$, such as 42-60 g/m$^2$, such as 45-60 g/m$^2$, such as 50-60 g/m$^2$.

22. The method of any one of items 17-21, wherein the dry matter content of the web obtained in step a) has a dry matter content of 17%-23%, such as 18%-22%.

23. The method of any one of items 17-22, wherein the first nip is not a shoe press nip.

24. The method of item 23, wherein the first nip is a roll press nip.

25. The method of any one of items 17-24, wherein the first nip is operated at a line load of 50-125 kN/m, such as 50-100 kN/m.

26. The method of any one of items 17-25, wherein the second nip is not a shoe press nip.

27. The method of item 26, wherein the second nip is a roll press nip.

28. The method of any one of items 17-27, wherein the second nip is operated at a line load of 50-150 kN/m, such as 80-150 kN/m.

29. The method of any one of items 17-28, wherein the machine speed of the press section is at least 1100 m/min, such as at least 1200 m/min, such as at least 1250 m/min.

30. The method of any one of items 17-29, wherein the density according to ISO 534:2011 of the paper is at least 1000 kg/m$^3$, such as at least 1100 kg/m$^3$.

31. A method of producing a paper, comprising the steps of:

i) drying a web in a drying section to obtain a dried web having a moisture content of 4%-7%, preferably 5%-6%;

ii) coating or impregnating the web obtained in step i) with a water-based composition comprising a polymeric agent;

iii) drying the coated or impregnated web from step ii) to obtain a dried web having moisture content of 10%-30%, preferably 12%-25%, more preferably 15-20%;

iv) subjecting the dried web obtained in step iii) to calendering in a calendering unit comprising at least two heated nips.

32. The method of item 31, wherein the polymeric agent is a carboxymethyl cellulose, a microfibrillated cellulose, a polyvinyl alcohol or a starch.

33. The method of item 31 or 32, wherein step ii) is carried out in a size press or a film press.

34. The method of any one of items 31-33, wherein step iii) comprises contactless drying, preferably using hot air.

35. The method of item 34, wherein step iii) further comprises drying by means of heated cylinders, such as steam-heated cylinders.

36. The method of any one of items 31-35, wherein the calendering unit of step iv) comprises a supercalender, preferably having 8-20 calender rolls.

37. The method of any one of items 31-36, wherein step iv) comprises the application of moisture to one side of the paper web prior to the first nip of the calendering unit.

38. The method of any one of items 31-37, wherein no calendering is carried out prior to step ii).

39. The method of any one of items 31-38, wherein the web is formed from a pulp comprising at least 50% sulphate or sulphite pulp, such as at least 70% sulphate or sulphite pulp.

40. The method of any one of items 31-39, wherein the web is formed from a pulp comprising less than 10% by dry weight inorganic filler, such as less than 5% by weight inorganic filler, such as less than 1% by dry weight inorganic filler, such as substantially no inorganic filler.

41. The method of any one of items 31-40, wherein the grammage according to ISO 536:2012 of the paper is 42-62 g/m$^2$, such as 50-60 g/m$^2$ or 53-62 g/m$^2$, such as 55-60 g/m$^2$.

42. The method of any one of items 31-41, wherein the density according to ISO 534:2011 of the paper is at least 1000 kg/m$^3$, such as at least 1100 kg/m$^3$.

43. The method of any one of items 31-42, wherein the thickness according to ISO 534:2011 of the paper is 35-55 m.

44. The method of any one of items 31-43, wherein the tensile energy absorption index of the paper is 1.2-1.7 J/g in the machine direction (MD) and 2.0-3.5 J/g in the cross direction (CD).

45. The method of any one of items 31-44, wherein the tensile stiffness index of the paper is 10-14 kNm/g in the MD and 3-6 kNm/g in the CD.

46. The method of any one of items 31-45, wherein the Gurley value according to ISO 5636-5:2013 of the paper is above 220 s, such as above 300 s.

47. The method of any one of items 31-46, wherein step iv) further comprises drying the paper from the calendering section to reduce the moisture content of the paper to below 5%, such as below 4%.

48. The method of any one of items 31-47, wherein step iv) decreases the moisture content of the web by at least nine percentage points.

49. The method of any one of items 31-48, further comprising rolling the paper to form a paper roll and wrapping the paper roll in a cover material providing a barrier against moisture and water vapour.

DETAILED DESCRIPTION

As a first aspect of the present disclosure, there is provided a method of producing a paper, comprising the steps of:

a) providing a pulp having a Schopper-Riegler (SR) number measured according to ISO 5267-1:1999 of 25-50, which pulp comprises at least 70% by weight sulphate or sulphite pulp;

b) diluting the pulp to a consistency of 0.1%-0.9%; and c) forming a web from the diluted pulp from step b) in a forming section at a machine speed of at least 1100 m/min, such as 1100-1800 m/min.

Sulphate/kraft pulp may be preferred since it is widely produced in large quantities. However, sulphite pulp may also be preferred since it is generally more easily refined than sulphate pulp. Further, a higher degree of fibre swelling can be obtained with sulphite pulp, which is a drawback from a drying perspective (the energy demand during drying is higher), but an advantage from a density perspective (swelling improves fibre conformability resulting in a more dense sheet).

In one embodiment, the pulp comprises at least 90% by weight sulphate or sulphite pulp.

Sulphate or sulphite pulp is used to obtain a paper that is tough enough for downstream processes, such as coating (that may be carried out at high speed), but also converting and use of the final package. The tensile energy absorption (TEA) of the paper of the first aspect is preferably at least 50 J/m$^2$ in both the machine direction (MD) and the cross direction (CD). In one embodiment, it is 50-150 J/m$^2$, such as 50-100 J/m$^2$, in the MD and 50-200 J/m$^2$, such as 80-170 J/m$^2$, in the CD. The TEA index (TEA divided by grammage) may be 1.2-1.7 J/g in the MD and 2.0-3.5 J/g in the CD. In the present disclosure, TEA is measured according to ISO 1924-3:2011.

The tensile stiffness index of the paper of the first aspect may be 10-14 kNm/g in the MD and 3-6 kNm/g in the CD. Thereby, the paper can make an efficient contribution to the rigidity of the final package when it is used as a layer in a packaging material. In the present disclosure, tensile stiffness index is measured according to ISO 1924-3:2011.

If the SR number is above 50, it will not be possible to dewater the diluted pulp in the forming section at sufficient speed. If the SR number is below 25, the properties of the final product will typically be inferior. If the consistency of the diluted pulp is above 0.9%, the is a great risk that the paper will be too porous and the paper surface too rough. If it is below 0.1%, too much water will have to be removed without any significant improvement of paper properties.

The width of the wire of the forming section may be 5000-8000 mm, preferably 7200-7500 mm, such as 7360 mm.

For the method of the first aspect, it is not necessary that the pulp comprises any pigments. In fact, it may be preferred that no pigments are added. Consequently, the pulp of the first aspect may comprise less than 5% pigment, such as less than 3% pigment, such as less than 1% pigment, such as substantially no pigment. Not only pigments are unnecessary or even undesired, but also other types of inorganic fillers. Hence the pulp of the first aspect may comprise less than 5% inorganic filler, such as less than 3% inorganic filler, such as less than 1% inorganic filler, such as substantially no inorganic filler. Accordingly, the ash content according to ISO 2144:2015 of the pulp is preferably less than 5%, such as less than 3%, such as less than 1%. If not indicated otherwise, the percentages of pulp components presented in the present disclosure are by dry weight.

The machine speed in step c) of the first aspect is preferably at least 1250 m/min, such as 1250-1800 m/min. For such speeds, double-wire forming (e.g. with a gap former) may be used.

The pulp of the first aspect may be diluted to a consistency of 0.1%-0.5%, such as 0.1%-0.4%, in step b). Thereby, fibre flocculation is reduced, which decreases the porosity of the final paper.

The grammage of the paper of the first aspect is typically in the range of 35-100 g/m$^2$, such as 42-60 g/m$^2$, such as 45-60 g/m$^2$, such as 50-60 g/m$^2$. The density is preferably at least 1000 kg/m$^3$, such as at least 1100 kg/m$^3$. An upper limit for the density may be 1400 or 1500 kg/m$^3$. The thickness is preferably 35-55 μm. A relatively low thickness is advantageous because it means that a larger area of paper can be fit onto one roll. In the present disclosure, grammage is measured according to ISO 536:2012 and density and thickness are measured according to ISO 534:2011.

The Gurley value of the paper of the first aspect is high, typically above 220 s, such as above 300 s, when measured according to ISO 5636-5:2013. The porosity of the paper of the first aspect may even be so low that it is not possible to determine a Gurley value according to ISO 5636-5:2013.

Step a) of the first aspect may comprise subjecting a starting pulp to low consistency (LC) refining to obtain the pulp having the desired SR number. The consistency of the pulp during LC refining is typically 2-6%, preferably 3-5%. The LC refining is preferably carried out in at least two stages, such as three stages, using LC refiners connected in series.

The pulp of the first aspect may comprise hardwood pulp and/or softwood pulp. In one embodiment, it comprises both, such as at least 30% by dry weight hardwood pulp and at least 30% by dry weight softwood pulp. When the proportion of softwood pulp is relatively high, such as at least 60%, it is beneficial if the consistency of the diluted pulp in step b) is relatively low, e.g. 0.1%-0.3%.

When the proportion of softwood pulp is relatively high, such as at least 70%, it is also beneficial if the SR number is in the lower part of the range, e.g. 25-35.

When the amount of softwood pulp is at least 60%, such as at least 70%, it is thus preferred that the pulp has a SR number of 25-35 and a consistency (after dilution) of 0.1%-0.3%.

When the proportion of hardwood pulp is relatively high, such as at least 70%, it is beneficial if the SR number is in the upper part of the range, e.g. 35-50, such as 35-45.

The pulp is preferably bleached. Thereby the concentration of elements or compounds that may give rise to taint and/or odour in the final package is reduced.

The dry matter content of the web leaving the forming section of step c) typically has a dry matter content of 17%-23%, such as 18%-22%, such as about 20%. This web is preferably subjected to pressing, e.g. according to steps β) and γ) of the second aspect described below. The pressed web may then be subjected to drying in a drying section. Further, the dried web may be coated or impregnated, e.g. according to steps i) and ii) of the third aspect described below. Finally, the coated or impregnated web may be subjected to drying and calendering, e.g. according to steps iii) and iv) of the third aspect described below.

As a second aspect of the present disclosure, there is provided a method of producing a paper, comprising the steps of:

α) obtaining a web from a forming section;

β) subjecting the web to pressing in a press section comprising a first, a second and a third nip, wherein the first nip is double-felted and the second and the third nip are single-felted and wherein the third nip is a shoe nip being operated at a line load of at least 1300 kN/m, such as at least 1500 kN/m; and γ) obtaining from the press section a pressed web having dry matter content of 42%-48%, such as 43%-47%.

The press section of step p) gives an optimal balance between runnability (the felt also acts as a web support), moisture removal from the wet web and reduction of the rewetting that occurs during the time the felt supports the web.

An upper limit for the line load in the shoe press nip may for example be 1800 kN/m.

The web typically has a width of 5000-8000 mm, preferably 7200-7500 mm and the width of the press section is adapted accordingly.

The length of the shoe nip is preferably between 150 and 300 mm.

The web of step a) may be formed from a pulp comprising at least 50% sulphate or sulphite pulp, such as at least 70% sulphate or sulphite pulp (as in the first aspect). Various embodiments of the pulp of the second aspect are described above in connection with the first aspect.

The web of step a) may for example be obtained according to steps a)-c) of the first aspect above. The embodiments of steps a), b) and c) described above thus apply to the second aspect mutatis mutandis.

Preferably, the first nip of the press section is not a shoe press nip. Instead, it is preferably a roll press nip. The first nip may be operated at a line load of 50-125 kN/m, preferably 50-100 kN/m.

Likewise, it is preferred that the second nip of the press section is not a shoe press nip. Instead, it may be a roll press nip. The second nip may be operated at a line load of 50-150 kN/m, preferably 80-150 kN/m.

In one embodiment, the line load of the second nip is higher than the line load of the first nip.

The machine speed of the press section is preferably at least 1100 m/min (e.g.
1100-1800 m/min), such as at least 1200 m/min (e.g. 1200-1800 m/min), such as at least 1250 m/min (e.g. 1250-1800 m/min).

Typically, the press impulse of the third nip is at least 60 kPa*s. In such case, the machine speed is not higher than 1700 m/min when the line load is 1700 kN/m.

Preferably, the press impulse of the third nip is at least 70 kPa*s. In such case, the machine speed is not higher than 1457 m/min when the line load is 1700 kN/m.

More preferably, the press impulse of the third nip is at least 80 kPa*s. In such case, the machine speed is not higher than 1125 m/min when the line load is 1500 kN/m and not higher than 1275 m/min when the line load is 1700 kN/m.

In one embodiment, the press impulse of the third nip is at least 90 kPa*s. In such case, the machine speed is not higher than 1000 m/min when the line load is 1500 kN/m and not higher than 1133 m/min when the line load is 1700 kN/m.

Various embodiments of the paper of the second aspect are described above in connection with the first aspect.

As a third aspect, there is provided a method of producing a paper, comprising the steps of:

i) drying a web in a drying section to obtain a dried web having a moisture content of 4%-7%, preferably 5%-6%;

ii) coating or impregnating the web obtained in step i) with a water-based composition comprising a polymeric agent;

iii) drying the coated or impregnated web from step ii) to obtain a dried web having a moisture content of 10%-30%, preferably 12%-25%, more preferably 15-20%;

iv) subjecting the dried web obtained in step iii) to calendering in a calendering unit comprising at least two heated nips, such as at least three heated nips.

The moisture content of step iii) facilitates the calendering operation and thereby provides for increased density, decreased porosity and improved surface properties in the final paper.

Accordingly, the method of the third aspect is not relying on any calendering carried out prior to coating or impregnation.

The reduction of the moisture content according to step i) makes it possible to fill the pores of the web during step ii).

The trim width of the paper machine used for the third aspect is preferably 5000-8000 mm, such as 5000-7000 mm, preferably 6500-6700 mm. This is also the case for the paper machine used for the first and the second aspect. As understood by the skilled person, the same paper machine is preferably used for the first, the second and the third aspect.

The polymeric agent may for example be a carboxymethyl cellulose, a microfibrillated cellulose, a polyvinyl alcohol or a starch. In addition to the polymeric agent, the water-based composition may comprise pigment, such as calcium carbonate, tale and/or clay.

Step ii) is preferably carried out in a size press or a film press.

The viscosity of the water-based composition is typically 10-1000 mPas, preferably 10-300 mPas, when measured as dynamic viscosity with a Brookfield rotational viscometer using spindle n0.4 at 100 rpm and 25° C. according to the Brookfield instruction sheet. To reach a desired viscosity, the water-based composition may comprise a rheology modifier.

Step iii) may comprise contactless drying. Such contactless drying preferably involves the application of hot air. Step iii) may also comprise drying by means of heated cylinders, such as steam-heated cylinders, after the contactless drying.

Step iv) may be carried out off-line a paper machine comprising the drying section of step i). In such case, the machine speed may be lower in step iv) than in step i).

The calendering unit of step iv) preferably comprises at least one supercalender, which may have 8-20 calender rolls. In some embodiments, the number of supercalenders in the calendering unit may be two or three.

Step iv) may comprise the application of moisture to one side of the paper web prior to the first nip of the calendering unit, preferably a side that is later coated with a barrier material.

The web of step i) may be formed from a pulp comprising at least 50% sulphate or sulphite pulp, such as at least 70% sulphate or sulphite pulp (as in the first aspect). Thereby, the tensile energy absorption (TEA) of the paper of the third aspect may be at least 50 J/m$^2$ in both the machine direction (MD) and the cross direction (CD). In one embodiment, it is 50-150 J/m$^2$ in the MD and 50-200 J/m$^2$ in the CD. The TEA index may be 1.2-1.7 J/g in the MD and 2.0-3.5 J/g in the CD.

Various embodiments of the pulp of the third aspect are described above in connection with the first aspect.

The preparation of the web of step i) may comprise steps a)-c) of the first aspect and/or steps α)-γ) of the second aspect. The embodiments of the first and the second aspect thus apply to the third aspect mutatis mutandis.

The grammage of the paper of the third aspect is typically 35-100 g/m$^2$ and preferably 42-62 g/m$^2$, such as 50-60 g/m$^2$ or 53-62 g/m$^2$, such as 55-60 g/m$^2$. The density is preferably at least 1000 kg/m$^3$, such as at least 1100 kg/m$^3$ and the thickness is preferably 33-55 μm, such as 35-49 μm. An upper limit for the density may be 1400 or 1500 kg/m$^3$.

At least one side of the paper of the third aspect preferably has a Bendtsen roughness of less than 50 ml/min, preferably less than 25 ml/min, more preferably less than 15 ml/min. A typical lower limit may be 5 or 7 ml/min. In the present disclosure, the Bendtsen roughness is measured according to SS-ISO 8791-2:2013.

The Parker Print Surface (PPS) roughness of at least one side of the paper of the third aspect may be in the range of 1.0 μm to 2.0 μm, such as 1.2 μm to 1.8 μm. In the present disclosure, the PPS roughness is measured according to SS-ISO 8791-4:2013.

Step iv) may further comprise drying the paper from the calendering section. Air dryers are preferably used for such additional drying. The additional drying may reduce the moisture content of the paper to below 5%, such as below 4%. Such a reduced moisture content facilitates the application of a barrier coating using a vacuum-based technology. A relatively low grammage is beneficial for the same reason. The lower limit for the moisture content may be 3% or 2%. At such a low moisture content, there may be a problem with static electricity. This problem may be alleviated by grounding the relevant papermaking equipment.

Accordingly, step iv) may decrease the moisture content of the web by more than eight percentage points, such as more than nine percentage points, such as more than ten percentage points (e.g. from 15% to below 5%).

The method of the third aspect may further comprise rolling the paper from step iv) to form a paper roll and wrapping the paper roll in a cover material, which preferably provides a barrier against moisture. Examples of such a cover material is paper laminated with a plastic film, such as kraft paper or kraft liner laminated with polyethylene.

The paper of the above aspects is preferably bleached because bleached paper generally contains less compounds that may give rise to taint and/or odour in the final package than unbleached paper. The ash content according to ISO 2144:2015 of the paper of the above aspects is preferably less than 5% (by dry weight), such as less than 3% (by dry weight), such as less than 1% (by dry weight).

For many barrier applications, the paper of the above aspects is intended to be coated. Because of the properties (density, low (no) porosity and/or smoothness) of the paper of the present disclosure, the coating can be relatively thin, which is beneficial from an environmental standpoint. Further, a thinner coating is typically cheaper and may facilitate recycling.

Example

A pulp comprising at least 70 wt. % bleached kraft pulp and 0-30 wt. % CTMP is provided. Preferably, the pulp is 100 wt. % bleached kraft pulp. Suitably, the bleached kraft pulp is a 50/50 mixture of bleached softwood kraft pulp and bleached hardwood kraft pulp.

The pulp is LC-refined, typically in three steps. The SR number of the LC-refined pulp is lower than in the typical production of greaseproof paper, i.e. lower than 50, but higher than in the production of conventional kraft paper, i.e. higher than 25. Preferably, the SR number of the LC-refined pulp is about 30 for the 50/50 mixture.

After refining, the stock is diluted to a consistency of 0.1%-0.9%, preferably about 0.3%, prior head box. If the proportion of softwood pulp is high, e.g. >60 wt. %, it is beneficial to use forming consistency in the lower part of the range, e.g. 0.1-0.3%. Forming may be carried out in a 1-ply fourdrinier wire section, but a 2-ply fourdrinier section may also be used. The latter may be beneficial since it reduces the risks of pinholes in the final paper. The machine speed in the wire section is at least 700 m/min, which is much higher than in conventional production of greaseproof paper. If double-wire forming (e.g. with a gap former) is used, the machine speed may be 1100 m/min or even higher. For such high-speed forming, the former may be an OptiFormer Gap/SpeedFormer HHS MB (Valmet) or a DuoFormer TQv (Voith). Compared to fourdrinier forming, this concept removes water in two directions instead of one.

The head box is preferably dilution-controlled for efficient adjustment of the cross direction grammage profile. An even profile in the cross direction improves the runnability, not only in downstream parts of the paper machine (film press and calender), but also in converting processes.

The web from the wire/forming section, which typically has a dry matter content of about 20%, is then pressed in a press section (in order to increase the dryness of the web). The press section is preferably closed or almost closed in order to avoid web brakes. The press section typically has at least two nips. A preferred configuration has three nips; a first double felted press nip followed by two single-felted press nips. The last press nip is preferably a shoe press designed for a line load in the range of 1500 to 1700 kN/m. Examples of suitable press sections are OptiPress Center (Valmet), SymPress 2 (formerly Metso, now Valmet) and DuoCentri NipcoFlex (Voith).

The above-mentioned press section configurations enable a high press dryness, i.e. a high dry matter content in the web leaving the press section. Typical values for press dryness are in the range of 42-48%.

Drying of the web from the press section is carried out using steam-heated cylinders. The drying cans are preferably made of steel instead of cast iron in order to improve heat transfer. The first and/or the second drying group may have a single-tier configuration for sufficient runnability at high machine speeds.

When the web has been dried to a moisture content of 4%-7% (preferably 5%-6%), it is coated or impregnated with a primer in a film press or a similar device. The primer is preferably starch, but it can also be CMC, MFC or polyvinyl alcohol (PVA). By this process step, many of the pores still left in the paper will be closed. The primer may also provide additional paper strength and improved barrier properties. If the film press is of the two-sided type, a backside coating can be applied for a further reduction of the porosity and/or curl control. The film press may be an OptiSizer Film (Valmet) or a SpeedSizer (Voith).

After the film press, the web is dried to a moisture content of 12%-25%, preferably about 15%. This drying is preferably carried out by contactless drying, preferably using hot air, until the primer is not sticking to hot metal surfaces followed drying by steam-heated cylinders.

The impregnated/coated web having a moisture content of 12%-25% (preferably about 15%) is then subjected to calendering using multiple nips, such as super-calendering. Thereby, smoothness and density are increased and most of the remaining pores are closed. The speed in the calendering operation is preferably lower than in the paper machine, which means that it is an off-line operation. A suitable super-calender has a calendar stack with 8-20 calendar rolls, wherein every other roll is steam-heated and the remaining rolls have a soft cover. Examples of super-calenders are OptiCalender Multinip (Valmet) and the Janus type (Voith). Prior the calender, the surface that eventually will be coated is preferably moisturized using spray nozzles or a steam box.

During the calendaring, the paper is dried out. Excess drying is possible by carrying out additional drying immediately after the calendering (i.e. prior to the reel). Air dryers can be used for such additional drying. With this set-up, a moisture content below 4% can be achieved.

After production, the rolls of the paper are preferably wrapped by a cover having a moisture and water vapor barrier in order to retain the low moisture content of the paper.

The paper machine for the production described above may have a trim width of 6600 mm, which is beneficial from a construction point of view. The machine speed is preferably 1300-1800 m/min and a typical grammage range is 30-100 g/m$^2$, preferably 40-60 g/m$^2$, such as 55-60 g/m$^2$. The number of square meters produced at full speed may thus be 1300*60*6600/1000=514800 m$^2$ per hour. At an overall machine efficiency of 81%, about 3.65 billion square meters of paper will be produced per year.

The invention claimed is:

1. A method of producing a paper, comprising the steps of: a) providing a pulp having a Schopper-Riegler (SR) number measured according to ISO 5267-1:1999 of 25-50, which pulp comprises at least 70% by weight sulphate or sulphite pulp wherein step a) comprises subjecting a starting pulp to low consistency (LC) refining to obtain the pulp having a Schopper-Riegler (SR) number measured according to ISO 5267-1:1999 of 25-50; b) diluting the pulp to a consistency of 0.1%-0.9%; and c) forming a web from the diluted pulp from step b) in a forming section at a machine speed of at least 1100 m/min and wherein the method further comprises the steps of pressing the web from step c), drying the pressed web in a drying section to obtain a dried web having a moisture content of 4%-7%, impregnating the dried web with a water-based composition comprising polyvinyl alcohol, and subjecting the impregnated web to drying and calendaring.

2. The method of claim 1, wherein the pulp comprises less than 5% by dry weight pigment.

3. The method of claim 1, wherein the pulp is diluted to a consistency of 0.1%-0.5% in step b).

4. The method of claim 1, wherein the machine speed in step c) is at least 1250 m/min.

5. The method of claim 1, wherein the grammage according to ISO 536:2012 of the paper is 42-60 g/m$^2$.

6. The method of claim 1, wherein the density according to ISO 534:2011 of the paper is at least 1000 kg/m$^3$.

7. The method of claim 1, wherein the Gurley value according to ISO 5636-5:2013 of the paper is above 220 s.

8. The method of claim 1, wherein the pulp comprises hardwood pulp and softwood pulp.

9. The method of claim 1, wherein the pulp comprises at least 60% by dry weight softwood pulp and the pulp is diluted to a consistency of 0.1%-0.3% in step b).

10. The method of claim 1, wherein the pulp comprises at least 70% by dry weight softwood pulp and has a Schopper-Riegler (SR) number measured according to ISO 5267-1: 1999 of 25-35.

11. The method of claim 1, wherein the pulp comprises at least 70% by dry weight hardwood pulp and has a Schopper-Riegler (SR) number measured according to ISO 5267-1: 1999 of 35-50.

12. The method of claim 1, wherein said LC refining comprises at least two consecutive steps.

13. The method of claim 1, wherein the dry matter content of the web leaving the forming section of step c) has a dry matter content of 17%-23%.

14. The method of claim 1, wherein the machine speed in step c) is 1100 m/min to 1800 m/min.

15. The method of claim 1, wherein the pulp comprises substantially no pigment.

* * * * *